United States Patent [19]

Kellett

[11] Patent Number: 5,066,413

[45] **Date of Patent: * Nov. 19, 1991**

[54] GELLED, DRYER-ADDED FABRIC-MODIFIER SHEET

[75] Inventor: George W. Kellett, Cranford, N.J.

[73] Assignee: Creative Products Resource Associates, Ltd., Clifton, N.J.

[ * ] Notice: The portion of the term of this patent subsequent to Jul. 3, 2007 has been disclaimed.

[21] Appl. No.: 568,836

[22] Filed: Aug. 17, 1990

Related U.S. Application Data

[63] Continuation-in-part of Ser. No. 521,242, May 9, 1990, which is a continuation-in-part of Ser. No. 331,870, Apr. 4, 1989, Pat. No. 4,938,879.

[51] Int. Cl.[5] ..... B05D 3/12; B06M 13/02; B06M 13/17; B06M 13/48

[52] U.S. Cl. ..... 252/8.75; 252/8.6; 252/8.8; 252/8.9; 427/247

[58] Field of Search ..... 252/8.6, 8.75, 8.8, 252/8.9; 427/242

[56] References Cited

U.S. PATENT DOCUMENTS

| | | | |
|---|---|---|---|
| 2,251,328 | 8/1941 | Ehret | 252/134 |
| 3,442,692 | 5/1969 | Gaiser | 117/120 |
| 3,650,816 | 3/1972 | Rudy et al. | 117/109 |
| 3,936,538 | 2/1976 | Marshall et al. | 427/242 |
| 3,977,980 | 8/1976 | Fry et al. | 252/8.8 |
| 4,022,938 | 5/1977 | Zaki et al. | 427/242 |
| 4,041,205 | 8/1977 | Compa et al. | 428/220 |
| 4,511,495 | 4/1985 | Melville | 252/522 |
| 4,514,444 | 4/1985 | Ives et al. | 427/242 |
| 4,532,063 | 7/1985 | Gueldenzopf | 252/90 |
| 4,557,852 | 12/1985 | Schulz et al. | 252/95 |
| 4,566,980 | 1/1986 | Smith | 252/8.6 |
| 4,581,385 | 4/1986 | Smith et al. | 521/111 |
| 4,938,879 | 7/1990 | Kellett | 252/8.75 |

FOREIGN PATENT DOCUMENTS

| | | | |
|---|---|---|---|
| 1017101 | 9/1977 | Canada | 8/93.11 |
| 225848 | 6/1987 | European Pat. Off. . | |
| 2416937 | 9/1979 | France . | |
| 1598449 | 9/1981 | United Kingdom . | |

*Primary Examiner*—Paul Lieberman
*Assistant Examiner*—J. Darland
*Attorney, Agent, or Firm*—Merchant, Gould, Smith, Edell, Welter & Schmidt

[57] ABSTRACT

A fabric-modifier sheet for in-dryer use is provided which comprises water, an organic solvent, and an amount of an organic gelling agent effective to dimensionally stabilize the sheet, having uniformly distributed in said sheet an effective amount of one or more fabric-modifying agents.

7 Claims, No Drawings

GELLED, DRYER-ADDED FABRIC-MODIFIER SHEET

CROSS-REFERENCE TO RELATED APPLICATION

This application is a continuation-in-part of U.S. patent application Ser. No. 07/521,242, filed May 9, 1990; which is a continuation-in-part of U.S. patent application Ser. No. 07/331,870, filed Apr. 4, 1989, now U.S. Pat. No. 4,938,879.

BACKGROUND OF THE INVENTION

Certain chemical compounds have long been known in the art to possess the desired quality of imparting softness to textile fabrics. The quality of "softness" or being "soft" is well defined in the art, and, as used herein, means that quality of the treated fabric whereby its handle or texture is smooth, pliable, and fluffy, and not rough or scratchy to the touch. Known generally as "fabric softeners," these compounds have long been used by homemakers in the laundry, and by the textile industry to soften a finished fabric.

Additionally, many of these compounds act to reduce the "static cling" of the treated fabrics. Static cling is generally the phenomenon of a fabric adhering to another object or to parts of itself as a result of static electrical charges located on the surface of the fabric. It can also cause the adherence of lint, dust, and other undesired substances to the fabric. It is noticeably present in unsoftened fabrics that are freshly washed and dried in an automatic hot air dryer. By softening and reducing the static cling of a fabric, it is more comfortable when worn. Such treated fabrics additionally are easier to iron, and have fewer hard-to-iron wrinkles.

Perhaps the most common fabric conditioners known in the art are cationic compounds, especially amines such as quaternary ammonium and imidazolinium salts. These compounds are widely marketed for home use in the form of liquid emulsions. They must be added to the laundry in the rinse cycle, not the wash cycle, because cationic fabric conditioners interact with anionic substances present in laundry detergents such as anionic surfactants and builder salts, thereby rendering both relatively ineffective. A commercial fabric conditioner of this type is Downy ® (The Procter & Gamble Company, Cincinnati, OH).

Another means of providing fabric conditioning is disclosed in Gaiser, U.S. Pat. No. 3,442,692, issued May 6, 1969, incorporated herein by reference, comprising a fabric-conditioning composition in conjunction with a dispensing means for use in a hot air dryer. Preferred articles had the fabric-conditioning composition releasably affixed to an absorbent substrate, such as a nonwoven tissue, in the form of an impregnate or coating of cationic fabric-conditioning agent. The use of certain polyesters, especially sorbitan esters as auxiliary fabric-conditioning agents in products of this kind, is disclosed in Zaki et al., U.S. Pat. No. 4,022,938, issued May 10, 1977, incorporated herein by reference. A commercial product that has utilized the teachings of Gaiser and Zaki et al. is Bounce ®, The Procter & Gamble Company.

Substrates having fabric-conditioning agents adhered to substrates formed from natural or synthetic organic polymers have also been disclosed. For example, Schulz et al., U.S. Pat. No. 4,557,852, disclose a water-soluble sheet formed from a synthetic acrylate-type polymer which encloses a fabric softener or a bleach. This laundry care additive is added to the washing machine. Marshall et al., U.S. Pat. No. 3,936,538, disclose a fabric-softening composition for use in the dryer consisting of a sheet of a film-forming polymer having a molecular weight of at least 100,000, a fabric softener and a surfactant. However, these compositions leave a "crumpled sheet residue behind" in the dryer.

Therefore, both the "absorbent substrate" and "all-chemical" type in-dryer softeners disclosed hereinabove can leave a residual base sheet which must be removed following the completion of the drying cycle. These sheets may be reusable to some extent, but the user has no way to readily determine whether or not sufficient softener is retained on the base sheet. Furthermore, although these products are easy to dispense, their efficacy depends on the efficient release of the fabric conditioner from a substrate which does not participate in the drying process, and which may itself decompose to soil the dried laundry. Also, in-dryer sheets generally do not soften as well as liquids, since the sheets may not contact all of the laundry evenly during the drying process. This can also lead to staining of the laundry due to the uneven release of the softener.

Therefore, there is a need for a solid fabric softener for use in an automatic hot air clothes dryer which is convenient to use, which softens effectively and which does not stain or otherwise soil the dried laundry.

BRIEF DESCRIPTION OF THE INVENTION

The present invention provides a fabric modifier comprising a gelled sheet that imparts softening, antistatic and/or other desirable properties to laundry while leaving no significant residue in the dryer after use therein. The sheet comprises water, a water miscible organic solvent such as a glycol ether, and an effective gel-forming amount of an organic gelling agent such as a fatty acid salt. Uniformly distributed throughout said sheet is an effective amount of one or more fabric-modifying agents, such as a quaternary amine fabric-softening agent. Preferably, the sheets will comprise a surfactant to enhance the dispersal of the sheet in the dryer.

The present modifier sheets are dimensionally stable, so that they can be readily dispensed by the user and added to the dryer in discrete units, along with, prior to, or after adding wet, laundered clothing or other laundered items. However, during drying of the laundry, the gelled solvent matrix evaporates, or otherwise disperses, and the modifiers are spread evenly onto the fabrics. No, or an insignificant residue from the present sheets, remains in a conventional rotary hot air dryer following exposure to a laundry drying cycle, so there is nothing for the user to remove but the dried laundry, which has been uniformly softened, rendered static-free, or otherwise modified, without being stained. As used herein, the term "insignificant" means that less than 5%, preferably less than 1%, and most preferably, 0% by weight of each sheet used, remains in the dryer after the laundry has been dried, either as free matter, or adhered to the dryer surface.

Therefore, the invention is also directed to a method for depositing fabric-modifying agents such as softening agents on fabrics in a rotary hot air dryer comprising placing one or more of the present sheets in the dryer with the wet fabrics, and operating the dryer to dry the fabrics. The term "laundry" or "fabrics" encompasses not only clothing, but other items which are commonly cleaned via household or institutional laundering, including sheets, draperies, rugs, upholstery coverings, towels and the like. As used herein, the term "dryer" refers to a rotary hot air dryer, which tumbles the clothes in a drum with hot air, usually at a temperature of about 40–90° C., preferably at about 50–95° C. Typical drying cycle times are given in the working examples, hereinbelow.

Since the gelled lattice of the present sheets is thermally unstable in that it disintegrates, solubilizes in the latent water carried in the wet laundry, and disperses when exposed to the elevated temperature in the dryer, the present sheets are fundamentally different from the water-soluble polymeric sheets disclosed by Schulz et al. or Marshall et al., hereinabove, which are intended to provide a thermally-stable matrix to protect and/or deliver fabric conditioning or laundry care additives. However, since the present sheets are water-soluble, they can be used in the washing machine as well. The present sheets also do not incorporate a water-insoluble support or reinforcing matrix of any type, e.g., of water-insoluble plastic, foam or textile.

Although the present invention is exemplified primarily as a sheet which delivers one or more quaternary amine fabric-softening agents, the invention is also intended to encompass a sheet which can deliver a wide variety of fabric-treating agents or fabric-modifying agents. For example, an effective amount of one or more fabric-modifying agents selected from the group consisting of anti-creasing agents, anti-soil agents, anti-static agents, bacteriostatic agents, brightening agents, bodying agents, dyes, odor-masking agents and fragrances, fiber emollients, finishing agents, germicides, lubricants, mildew- or moth-proofing agents, shrinkage controllers, sizing agents, and mixtures thereof can be uniformly distributed throughout the present sheet, in conjunction with, or in place of, a fabric-softening agent such as a quaternary amine fabric-softening agent. When formulated in this manner, the present sheet is referred to as a "fabric modifier" or "fabric-modifying sheet" instead of as a "fabric softener" or "fabric-softener sheet".

Therefore, the present invention also includes a fabric modifier comprising a gelled sheet formed by a process comprising the steps of (a) forming a uniform liquid dispersion of at least one fabric-modifying agent and an organic gelling agent in mixture of water and an organic solvent; and (b) forming the dispersion into a dimensionally stable gelled sheet.

The present invention also provides a method for depositing a fabric-modifying agent on fabrics in a rotary hot air dryer comprising placing the present fabric modifier in the dryer with wet fabrics, and operating the dryer to dry the fabrics.

A further aspect of the present invention is a base sheet comprising a gelled sheet which comprises water, a water-miscible organic solvent, and an effective gel-forming amount of an organic gelling agent. This is the base or carrier sheet for the fabric-modifying agent or agents. Another utility of the base sheet lies in the provision of fabric-softening effect due to the presence of the alkali metal stearate.

DETAILED DESCRIPTION OF THE INVENTION

The present sheets are preferably prepared by forming a uniform, heated liquid dispersion of at least one fabric-modifying agent such as a quaternary amine fabric-softening agent, a surfactant, an organic gelling agent and, optionally, fragrance in a water-miscible organic solvent; and cooling and forming said mixture into a dimensionally stable gelled sheet.

Fabric-Softening Agent

The present modifier sheet gels will preferably include an amount of one or more fabric-softening agents uniformly dispersed throughout the body of the sheet. Many useful fabric-softening agents are known to the art, and are disclosed, for example, in U.S. Pat. Nos. 3,936,538; 4,566,980 and 4,581,385, disclosures of which are incorporated by reference herein.

One broad class of these agents can be referred to as quaternary amines, or "quats." These materials function to condition the dried fabrics and to reduce static cling and lint adherence. The fabrics are softened in that their sheen, loft, and/or hand-feel is improved by either subjective or objective evaluation. Additionally, any given softening agent or mixture thereof is selected so that it will not significantly stain or discolor the dried fabrics.

Subclasses of these materials are referred to by the art as monomethyl trialkyl quaternaries, imidazolinium quaternaries, dimethyl alkyl benzyl quaternaries, dialkyl dimethyl quaternaries, methyl dialkoxy alkyl quaternaries, diamido amine-based quaternaries and dialkyl methyl benzyl quaternaries wherein the "alkyl" moiety is preferably a ($C_8$–$C_{24}$) alkyl group and the quaternary (amine) is a chloride or methosulfate salt.

For convenience, one subclass of aliphatic quaternary amines may be structurally defined as follows:

$$(R)(R_1)(R_2)(R_3)N^+X^-$$

wherein R is benzyl, or lower(alkyl) benzyl; $R_1$ is alkyl of 10 to 24, preferably 12 to 22 carbon atoms; $R_2$ is $C_{10}$–$C_{24}$-alkyl, $C_1$–$C_4$-alkyl, or ($C_2$–$C_3$)hydroxyalkyl, $R_3$ is $C_1$–$C_4$-alkyl or ($C_2$–$C_3$) hydroxyalkyl and X represents an anion capable of imparting water solubility or dispersibility including chloride, bromide, iodide, sulfate and methosulfate. Particularly preferred species of these aliphatic quats include n-$C_{12}$–$C_{18}$-alkyl-dimethylbenzylammonium chloride (myrisalkonium chloride), n-$C_{12-C14}$-alkyldimethyl(ethylbenzyl) ammonium chloride (quaternium 14), dimethyl-(benzyl)ammonium chloride and mixtures thereof. These compounds are commercially available as the BTC series from Onyx Chemical Co., Jersey City, NJ. For example, BTC 2125M is a mixture of myrisalkonium chloride and quaternium-14. Dihydrogenated tallow methyl benzyl ammonium chloride is available as Variguat ® B-343 from Sherex Chem. Co., Dublin, OH. This class of quat is germicidal, and is preferably used in combination with at least one of the other quats disclosed hereinbelow.

Other useful aliphatic quats include those wherein both R and $R_1$ are ($C_8$–$C_{24}$)alkyl, e.g., the N,N-di-(higher)-$C_{10}$–$C_{24}$-alkyl-N,N-di(lower)-$C_1$–$C_4$-alkyl-quaternary ammonium salts such as distearyl(dimethyl)ammonium chloride, dihydrogenated tallow(dimethyl)ammonium chloride, ditallow(dimethyl)ammonium chloride (Arquad ® 2HT-75, Akzo Chemie, McCook, IL), distearyl(dimethyl)ammonium methylsulfate and dihydrogenated-tallow(dimethyl)ammonium methyl sulfate (Varisoft ® 137, Sherex).

Other useful quaternary ammonium antistatic agents include the acid salts of (higher(alkyl)-amido(lower)-alkyl)-(dialkyl)-amines of the general formula:

$$[(A(C{=}0)-Y-)-N(R_1)(R_2)(R_3)]^{+X-}$$

wherein A is a $C_{14}$–$C_{24}$ normal or branched alkyl group, Y is ethylene, propylene or butylene, $R_1$ and $R_2$ are individually H, $C_1$–$C_4$ (lower)alkyl or ($C_1$–$C_3$) hydroxyalkyl or together form the moiety $-CH_2-CH_2YCH_2-CH_2-$, wherein Y is NH, 0 or $CH_2$; $R_3$ is the same as $R_1$ or is also [A(C=0)Y—], and X is the salt of an organic acid. Compounds of this class are commercially available from Croda, Inc., New York, NY, as the Incromate® series, e.g. Incromate® IDL [isostearamidopropyl(dimethyl)amine lactate], Incromate® ISML [isostearamidopropy(morpholinium)lactate]and Incromate® CDP [cocamidopropyl(dimethyl)amine propionate]. Ditallowdiamido methosulfate (quaternium 53) is available from Croda as Incrosoft® T-75.

Preferred imidazolinium salts include: (methyl-1-tallow-amido)ethyl-2-tallow imidazolinium methyl sulfate; available commercially from Sherex Chemical Co. as Varisoft® 475; (methyl-1-oleylamido)ethyl-2-oleyl imidazolinium methyl sulfate; available commercially from Sherex Chemical Co. as Varisoft® 3690, tallow imidazolinium methosulfate (Incrosoft® S-75, Croda) and alkylimidazolinium methosulfate (Incrosoft® CFI-75, Croda).

Other useful amine salts are the stearyl amine salts that are soluble in water such as stearyl-dimethylamine hydrochloride, distearyl amine hydrochloride, decyl pyridinium bromide, the pyridinium chloride derivative of the acetylaminoethyl esters of lauric acid, lauryl trimethyl ammonium chloride, decylamine acetate and bis[(oleoyl)-(5,8)-ethanoloxy]-tallow($C_{14}$–$C_{18}$)aminehydrogen phosphate (Necon® CPS-100) and the like.

Surfactant

One or more surfactants can optionally be used in the present modifier sheets, to assist in the formation of a uniform liquid dispersion which is the precursor of the present sheets, and to assist the dispersal of the sheets in the dryer. Nonionic surfactants or amphoteric surfactants are preferred for use in the present invention and can also act as adjunct fabric softeners. Minor but effective amounts of certain anionic surfactants may also be useful in the present invention to provide improved water-solubility and faster dissipation of the sheets in the dryer. Nonionic surfactants include the condensation products of ethylene oxide with a hydrophobic polyoxyalkylene base formed by the condensation of propylene oxide with propylene glycol. The hydrophobic portion of these compounds has a molecular weight sufficiently high so as to render it water-insoluble. The addition of polyoxyethylene moieties to this hydrophobic portion increases the water-solubility of the molecule as a whole, and the liquid character of the product is retained up to the point where the polyoxyethylene content is about 50% of the total weight of the condensation product. Examples of compounds of this type include certain of the commercially-available Pluronic® surfactants (BASF Wyandotte Corp.), especially those in which the polyoxypropylene ether has a molecular weight of about 1500–3000 and the polyoxyethylene content is about 35–55% of the molecule by weight, i.e., Pluronic® L-62.

Preferred nonionic surfactants include the condensation products of $C_8$–$C_{22}$ alkyl alcohols with 2–50 moles of ethylene oxide per mole of alcohol. Examples of compounds of this type include the condensation products of $C_{11}$–$C_{15}$ fatty alcohols with 3-50 moles of ethylene oxide per mole of alcohol which are commercially available from Shell Chemical Co., Houston, TX, as, i.e., Neodol® 23-6.5 ($C_{12}$–$C_{13}$ fatty alcohol condensed with about 7 moles of ethylene oxide), the Polytergent® SLF series from Olin Chemicals or the Tergitol® series from Union Carbide, i.e., Tergitol® 15-S-15, which is formed by condensing about 15 moles of ethylene oxide with a $C_{11}$–$C_{15}$ secondary alkanol; Tergitol® TMN-6, which is the condensation product of about 6 moles of ethylene oxide with isolauryl alcohol (CTFA name: isolaureth-6), Incropol® CS-12, which is a mixture of stearyl and cetyl alcohol condensed with about 12 moles of ethylene oxide (Croda, Inc.) and Incropol® L-7, which is lauryl alcohol condensed with about 7 moles of ethylene oxide (Croda, Inc.).

Preferred nonionic surfactants also include ($C_8$–$C_{24}$) fatty acid amides, e.g., the monoamides of a mixture of arachidic and behenic acid (Kenamide® B, Humko Chem. Co., Memphis, TN), and the mono- or dialkanolamides of ($C_8$–$C_{22}$) fatty acids, e.g., the diethanol amide, monoethanol amide or monoisopropanolamide of coconut, lauric, myristic or stearic acid, or mixtures thereof. For example, Monamide® S is the monoethanol amide of stearic acid (Mona Industries, Inc., Patterson, NJ).

Other nonionic surfactants which may be employed include the ethylene oxide esters of $C_6$–$C_{12}$ alkyl phenols such as (nonylphenoxy)polyoxyethylene ether. Particularly useful are the esters prepared by condensing about 8–12 moles of ethylene oxide with nonylphenol, i.e., the Igepal®CO series (GAF Corp., New York, NY).

Other useful nonionics include the ethylene oxide esters of alkyl mercaptans such as dodecyl mercaptan polyoxyethylene thioether, the ethylene oxide esters of fatty acids such as the lauric ester of polyethylene glycol and the lauric ester of methoxypolyethylene glycol, the ethylene oxide ethers of fatty acid amides, the condensation products of ethylene oxide with partial fatty acid esters of sorbitol such as the lauric ester of sorbitan polyethylene glycol ether, and other similar materials, wherein the mole ratio of ethylene oxide to the acid, phenol, amide or alcohol is about 5–50:1.

Useful amphoteric surfactants are known to the art, e.g., as disclosed in Marshall et al. (U.S. Pat. No. 3,936,538), the disclosure of which is incorporated by reference herein.

Useful anionic surfactants are known to the art, including sodium cocoyl isethionate, commercially available as Jordapon® CI from Mazer Chemicals, Gurnee, Illinois. The anonionic surfactant may be optionally added in minor but effective amounts, e.g., up to about 1%, in addition to the optional nonionic or amphoteric surfactant, in order to enhance the water-solubility of the present modifier sheets.

Organic Gelling Agent

The present gelled fabric modifier sheets will also include an amount of an organic gelling agent which is effective to gel the liquid dispersions when they are cooled and formed into sheets. Any organic gelling agent or mixture of organic gelling agents can be used which imparts sufficient dimensional stability to the sheets during manufacture, storage and use, and which yields sheets which disperse leaving no significant residue in the dryer after use therein. Useful gelling agents can include metal complexes of polysaccharide gums, i.e., polysaccharide gums that are gelled in situ by the addition of an effective amount of one or more metal or ammonium cations. Preferred gums for use in the present invention include vegetable gums, such as the alkali metal salts of alginic acid ("alginates"), carrageenan (preferably kappa-carrageenan), pectin, and mixtures thereof. These "strong gums" re-gel from solution or dispersion to yield a continuous gel structure which is suitable as the matrix of the invention. The cations which can gel the gums comprise alkali metal, alkaline earth metal or ammonium cations. Useful divalent cationic gelling agents also include copper (II), cadmium (II), barium (II), strontium (II), cobalt (II), nickel (II), zinc (II), manganese (II) and iron (II) cations. Useful trivalent cations include aluminum (III), chromium (III) and iron (III). Also useful are heavy metal compounds which yield mobile ions in solution. Preferred water-soluble ionic compounds are selected from pharmaceutically acceptable fluorides, citrates, phosphates, tartrates, sulfates, acetates, borates, chlorides and the like, of cations such as sodium, lithium, potassium, magnesium, calcium and ammonium. Especially preferred are inorganic salts, i.e., chloride salts such as potassium chloride (KCl), calcium chloride ($CaCl_2$) and mixtures thereof.

Other organic gelling agents useful in the practice of the present invention include polyvinylpyrrolidone and polymeric organic waxes. The useful polymeric waxes include ethylene acrylate copolymers, ethylene acrylic acid copolymers and polyethylene (e.g., oxidized polyethylenes). These materials are commercially available in the form of aqueous emulsions or dispersions, e.g., from Allied Chemical, Morristown, NJ, as the A-C Copolymer and A-C Polyethylene series, such as A-C Copolymer 540, A-C Copolymer 580 and A-C Polyethylene 617 and 629. Waxy polyethylene glycols (PEG) such as those of a molecular weight of about 800 to 1700–2000 are preferred for use in the present gels.

Preferred organic gelling agents include the alkali earth metal, alkaline earth metal or ammonium salts of various naturally occurring or synthetic fatty acids. Useful fatty acids may be selected from one or more ($C_8$–$C_{22}$) fatty acids which incorporate 0–3 double bonds per fatty acid molecule, e.g., myristic acid, stearic acid, palmitic acid, lauric acid, behenic acid and the like. Alkali metal salts of fatty acids such as stearic acid are preferred. For example, sodium stearate is available from Witco Chem. Co. as Grade T-1. However, the fatty acid salt can be formed in situ in the liquid dispersion, by neutralizing the acid with a base such as an alkali metal hydroxide, e.g., LiOH, KOH, or NaOH, which may be added to the dispersion as an aqueous solution. Likewise, the gelling agent comprising the polysaccharide gum is gelled in situ by addition of an effective amount of a cation.

Solvent System

The present sheets are formed by dispersing the above-described active ingredients in an aqueous solvent system which preferably comprises a water-miscible organic co-solvent or solvent system.

Alcohols which can be employed in the present invention include liquid polyethylene glycols, i.e., polyethylene glycol-200, 300, 400 or 600, wherein the suffixed numbers indicate the approximate molecular weight of the glycol. Although a polyethylene glycol can be employed as the sole organic solvent, it is often desirable to adjust the viscosity and solubilization power of the primary solvent by the use of co-solvents. Useful co-solvents include other alcohols, for example: (a) lower (alkanols), such as ethanol, isopropanol, and n-butanol; or (b) $C_2$–$C_4$ polyols, such as a diol or triol, e.g., ethylene glycol, propylene glyol, glycerol or mixtures thereof. Most preferably, the major portion of the organic solvent will be a glycol ether. These materials are lower(alkoxy)- or lower(alkoxy)lower(alkoxy)-ethers of ethanol or isopropanol. Many glycol ethers are available under the tradenames Arcosolv® (Arco Chemical Co.) or Cellosolve®, Carbitol®, or Propasol® (Union Carbide Corp.), and include, e.g., butylCarbitol®, hexylCarbitol®, methylCarbitol®, and Carbitol® itself, (2-(2-ethoxy)ethoxy)ethanol. The choice of glycol ether can be readily made by one of skill in the art on the basis of its volatility, water-solubility, wt-% of the total dispersion and the like. Pyrrolidinone solvents such as N-methyl-2-pyrrolidinone (M-Pyrol®) or 2-pyrrolidone (2-Pyrol®) can also be used.

Fragrance

Minor but effective amounts of a volatile odoriferous agent selected so as to be chemically compatible with the above-described materials are preferably included in the sheets to deodorize the fabrics. Useful fragrances include oils such as rose oil, lavender, lilac, jasmine, vanilla, wisteria, lemon, apple blossom, or compound bouquets such as citrus, spice, aldehydic, woody, oriental, and the like.

Strength Enhancers

Preferred embodiments of the present fabric-modifier sheet may optionally include minor but effective amounts of one or more specific additives which increase the strength of the sheet. As used herein with respect to the present gelled sheets, a "strength-enhancing" additive refers to one which advantageously enhances the structural integrity of the gelled sheet and reduces the fragility of the sheet, prior to its placement in the dryer. With the addition of a strength-enhancing additive, the present gelled sheets can advantageously be flexed without breaking, prior to their placement in the dryer. The strength-enhancing additive, which is thermally unstable and water-soluble, is selected so as not to increase the amount of residue which may be left in the dryer after the laundry has been dried. The strength-enhancing additive may also increase the water-solubility of the present sheets.

Useful strength-enhancing additives include the high molecular weight acrylate copolymers available from the Interpolymer Corporation, Canton, Mass., by the tradenames CX30-67-1 and Syntran KL-219-C. These cationic copolymers have the formula $(—CH_2\text{-}CH\text{-}COOR)_n$, where n is greater than 50 for CX30-67-1, and n is greater than 100 for Syntran KL-219-C. Other useful strength-enhancing additives include polyethylene glycol condensates of fatty acids. A preferred polyethylene glycol condensate of a fatty acid is commercially available as PEG 600 Monostearate from Akzo Chemie. Other useful strength-enhancing additives include polyvinyl pyrrolidone/vinyl acetate copolymers. Preferred polyvinyl pyrrolidone/vinyl acetate copolymers are commercially available as PVP/VA E-335 and E-775 from GAF Corporation, Wayne, New Jersey.

Fabric-Modifying Agents

One or more additional fabric conditioning or modifying agents may be used in combination with, or in place of, the fabric-softening agent. When utilized in this manner, about 2.5–25%, preferably about 5-15% of total fabric-modifying agents will be present in the aqueous dispersion from which the gelled sheet is formed.

Useful fabric-modifying agents include the following:

Anti-creasing agents (also referred to as wrinkle-release agents) such as corn starch, polyvinyl acetate, and mixtures thereof;

Anti-soil agents (also referred to as soil-release agents) such as the polyacrylic polyvinyl alcohol compositions described in U.S. Pat. No. 3,377,249;

Anti-static agents including liquid anti-static agents such as the commonly-employed nonionic and anionic surfactants, as well as cationic amine surfactants such as tertiary or quaternary amines (many of the quaternary amine fabric-softening agents described hereinabove provide some anti-static effect); particulate anti-static agents such as aluminum oxide and stearates such as aluminum stearate; and mixtures thereof;

Bacteriostatic agents including alkyl dimethyl benzylammonium chloride, dodecyl trimethyl ammonium chloride and mixtures thereof;

Useful brightening agents include optical brighteners such as the disulfonated diaminostilbene compounds disclosed in U.S. Pat. No. 2,612,501, and the triazole compounds disclosed in U.S. Pat. No. 2,784,183;

Bodying agents such as carboxymethyl cellulose, hydroxyethylcellulose, starch, polyvinyl acetate and the like;

Dyes;

Fiber emollients including silicone fluids;

Finishing agents;

Germicides include the halogenated salicylanilides, hexachlorophene, neomycin sulfate, benzalkonium quaternary compounds, and the like, as described in U.S. Pat. No. 3,650,816;

Lubricants such as polyoxyethylene sorbitan monolaurate and methyl oleate;

Mildew-proofing or moth-proofing agents such as dialkyl quaternary ammonium salts, e.g., distearyl dimethyl ammonium chloride;

Shrinkage controllers such as caustic soda used in mercerizing strength, water-soluble resinous pre-condensates, and glyoxal; and Sizing agents.

For a general description of fabric-modifying agents, see H. Speel and E. Schwarz, *Textile Chemicals and Auxiliaries, 2d. ed.* (Reinhold Pub. Corp. 1957).

Formation of Sheet

The present dispersions are formed by combining the active ingredients in a mixture of the organic solvent and water under suitable conditions of agitation and temperature control. The solid gelled sheets are formed from the finished dispersion, e.g., by casting the dispersion onto a suitable moving or stationary surface, as by dipping, spraying or brushing the dispersion onto the surface of a mold, plate or movable belt. See U.S. Pat. No. 3,936,538, the disclosure of which is incorporated by reference herein. The finished sheet may be perforated for division into smaller units, or simply cast into its enduse size. The individual sheets or a strip comprising a plurality of sheets separated by perforations may be packaged, e.g., using protective release sheets, in an appropriate dispensing unit. The present sheets can also be made by coating a cooled metal roller with the reaction mixture and removing the cast sheet with a doctor blade to control its thickness.

Therefore, the aqueous dispersions used to form the present fabric-modifying sheets will comprise, by weight, about 40–60% of at least one water-miscible organic solvent, preferably about 45–55% of a glycol ether or pyrrolidinone solvent; about 10–30%, preferably about 15–27.5% total water; about 2.5–25%, preferably about 5-15% of one or more fabric-modifying agents; about 7–20% gelling agent, preferably a fatty acid salt; and optionally about 1–10% of a surfactant, preferably about 2.5–7.5% of a nonionic surfactant, and a minor but effective amount of fragrance, e.g. $\leqq 1\%$. The aqueous dispersion may also optionally include about 1–10%, preferably about 1–5% of a polymeric strength-enhancing additive. The optional surfactant component may also preferably include a minor but effective amount, e.g., up to about 1% by weight of the total aqueous dispersion, of an anionic surfactant, so as to increase the water-solubility of the sheet.

With respect to the base sheet of the present invention, the aqueous dispersions used to form the base sheet will comprise, by weight, about 45–65% water-miscible organic solvent, preferably about 50–60% of a glycol ether or pyrrolidinone solvent; about 10–30%, preferably about 15–27.5% total water; about 7–20% gelling agent, preferably an alkali metal stearate; and optionally about 1–10% of a surfactant, preferably about 2.5–7.5% of a nonionic surfactant, and a minor but effective amount of fragrance, e.g. $\leqq 1\%$. The aqueous dispersion may also optionally include about 0.5–10%, preferably about 1–5% of a strength-enhancing additive. The optional surfactant component may also preferably include a minor but effective amount, e.g., up to about 1% by weight of the total aqueous dispersion, of an anionic surfactant, so as to increase the water-solubility of the sheet.

The invention will be further described by reference to the following detailed examples.

EXAMPLE 1

Fabric-Softening Sheet

Carbitol® solvent ((2-(2-ethoxyethoxyethanol, 49 g) is added to a beaker equipped with mechanical stirring, followed by 13.3 g of water. The stirred reaction mixture is heated to 60° C, at which point 12.25 g of stearic acid (Neofat® 18, Armak Co., McCook, IL) is added. When the temperature of the reaction mixture reaches 75° C, 3.45 g of 50% aqueous sodium hydroxide is slowly added, raising the temperature of the reaction mixture to about 80–85° C. After the neutralization reaction is completed, the temperature is maintained at 80° C. Incrosoft® T-75 softener (quaternium 53, 14.1 g, Croda, 75% active) is added, and stirring continued until the reaction mixture is homogeneous. Incropol® CS-12 surfactant (ceteareth-12, 2.36 g) and Kenamide® B surfactant (behenamide/arachidamide 4.71 g) are slowly added, followed by 0.7 g of fragrance. After 1–2 minutes of additional stirring, stirring is discontinued. The reaction mixture is cast into thin sheets by dipping a highly polished chrome plate into the 80° C reaction mixture for 5 seconds. The liquid-coated plate is removed and cooled and the gelled sheet is stripped from the plate. Flexible translucent sheets resulted which were about 12.7 cm square (2.1–2.3 g).

Test fabrics (towels and sheets) are washed with a 15 min regular wash cycle (warm wash/cold rinse; water level, medium). One softener sheet is placed in the dryer drum with the damp wash and dried for a total of 55 min. After 20 min, the softener sheet is completely consumed and the test fabrics are effectively softened without visible staining.

EXAMPLES 2-6

Examples 2-6 were carried out using the procedure of Example 1, to yield softener sheets that were also effective to soften and neutralize static test fabrics under the best conditions described hereinabove, without leaving a visible residue in the dryer drum. The compositions of the sheets of Examples 2-6 are summarized on Table I, below.

TABLE I

| Ingredient | Example No. 2 | 3 | 4 | 5 | 6 |
|---|---|---|---|---|---|
| Solvent | | | | | |
| Carbitol ® | 47.9 | 54.1 | 51.4 | 54.1 | 51.4 |
| Water (total) | 14.7 | 17.4 | 15.8 | 19.4 | 15.8 |
| Softener | | | | | |
| Incrosoft ® T-75 (Quaternium-53)[a] | 18.4 | 5.2 | 9.9 | 3.9 | 7.4 |
| Incrosoft ® S-75 (Quaternium-27)[b] | — | — | — | 1.3 | 2.5 |
| Stearic acid | 12.0 | 13.5 | 12.9 | 13.5 | 12.9 |
| NaOH | 1.7 | 1.9 | 1.8 | 1.9 | 1.8 |
| Surfactant | | | | | |
| Behenamide/Arachidamide[c] | 4.6 | 4.7 | 5.0 | 5.2 | 4.95 |
| Ceteareath-12[d] | — | 2.4 | 2.5 | 2.6 | 2.54 |
| Fragrance | 0.7 | 0.8 | 0.7 | 0.8 | 0.8 |

[a](75% actives, Croda Surfactants, Inc., NY, NY)
[b](75% actives, Croda)
[c]Kenamide ® B (Witco Chem. Co., Memphis, TN)
[d]Incropol ® CS-12 (Croda)

EXAMPLES 7-13

Examples 7-13 were carried out using the procedures of Example 1, except that in Examples 12-13, the neutralization step was omitted and preformed sodium stearate was used. All of the examples yielded sheets which were satisfactory in terms of their dimensional stability. The sheets were about 100-175 $cm^2$, about 0.45-0.65 mm thick and weighed about 6.5-8.5 g.

The sheets were evaluated in a Beaumark dryer along with a fixed test load for residue (%), static [volts; Bounce ®=1776 v] and staining [0-30 scale, Bounce=5.4], by the following protocols:

Test Fabrics

One sheet from each example was evaluated in the dryer with a wet load consisting of ten pieces of the following description: 2 pieces woven polyester (color fuchsia), 2 pieces nylon tricot (mauve), one piece cotton/polyester broadcloth (green), 2 pieces acrylic plush (yellow and aqua), one cotton./polyester pillowcase (bluegray), one piece polyester knit (blue), and one acrylic sweater (white), two bath-size 90% cotton/10% polyester towels and one hand-size towel of the same fiber blend. The total dry fabric weight is about 5 lbs.

Residue

After drying fabrics with the test sheet, test fabrics are removed from dryer and the inside of dryer is closely inspected for residue. Residue may be found as pieces in the lint trap, in the mouth of the dryer opening, tangled in the clothes, on the floor outside the dryer (from falling from clothes when they are removed), loose inside the dryer drum, or adhering to the dryer drum. All residue is collected and weighed and the residue is expressed as a percentage of original sample weight.

Static

Static voltage is measured for each item in a bulk load and individual voltages are summed to give total voltage for the load.

Softening

Softening is assessed using towels which have been laundered and dried along with other bulk load items. Three internal replicates are used in each test. Towels which are evaluated against each other (each having been treated with a test sample or Bounce ® control in the dryer) are ranked for softness as less than (<), equal to (=), or greater than (>) the softening ability of the Bounce ® sheet.

Fabric Staining

Fabric staining is assessed on six stain-prone items which are part of the 5 lb. standard bulk load. Items are: 2 pieces woven 100% polyester, 2 pieces 100% nylon tricot, one 65/35% cotton/polyester pillowcase, and one square meter 65/35% cotton/polyester broadcloth. Burgundy, fuchsia, royal blue, and emerald green have been found to be the most beneficial colors for stain visualization.

Staining is assessed immediately after fabrics are removed from the dryer. Each stain-prone fabric is visually inspected for any mark, which may be in the form of dark, oily, irregularly-shaped spots, streaks, or patches, or white, oily or powdery spots, streaks, or patches which are sometimes (but not always) removable by scraping. Staining of each fabric is rated according to the following scale and the numbers are totalled.

0 =no staining
1 =very slight staining (few small dots)
2 =slight staining (several small dots or streaks)
3 =moderate staining (dots, streaks, up to ½ in. patches)
4 =severe staining (all above+a few patches>½ in.)
5 =very severe staining (all above+several>½ in. patches)

The compositions of the sheets of Examples 7-13 are summarized on Table II, below, along with the averages of the length, width, thickness, initial weight, residue (%), static, and fabric staining for three sheets from each example. All of the sheets deposited no or an insignificant amount of residue in the dryer, and performed at least as well as the Bounce ® control sheet in the static, softness and fabric-staining evaluations described hereinabove.

TABLE II

| Ingredient | Example 7 | 8 | 9 | 10 | 11 | 12 | 13 |
|---|---|---|---|---|---|---|---|
| Solvent | | | | | | | |
| Carbitol ® | 50.4 | 48.1 | 51.2 | 47.3 | 50.4 | 57.2 | 56.9 |
| Water (total) | 21.7 | 21.8 | 21.2 | 21.1 | 21.1 | 17.5 | 17.0 |
| Softener | | | | | | | |
| Incrosoft T-75 (Quaternium-53)[a] | 5.0 | — | — | 3.5 | 5.0 | — | 5.0 |
| 90% Varisoft ® | 4.2 | 8.2 | 8.3 | 8.7 | 4.2 | 8.3 | 4.2 |

TABLE II-continued

| Ingredient | Example 7 | 8 | 9 | 10 | 11 | 12 | 13 |
|---|---|---|---|---|---|---|---|
| 137[b] | | | | | | | |
| Sodium Stearate | — | — | — | — | — | 12.2 | 12.2 |
| Stearic Acid | 12.3 | 12.3 | 12.2 | 12.2 | 12.2 | — | — |
| NaOH | 1.7 | 1.7 | 1.7 | 1.7 | 1.7 | — | — |
| Surfactant | | | | | | | |
| Behenamide/ Arachidamide[c] | 4.7 | 4.7 | 4.7 | 4.7 | 4.7 | 4.7 | 4.7 |
| Ceteareth-12[d] | — | 2.4 | — | — | — | — | — |
| Fragrance | — | 0.8 | 0.7 | 0.7 | 0.7 | — | — |
| Properties of Sheet | | | | | | | |
| Length (cm) | 14.1 | 11.9 | 11.3 | 12.5 | 13.6 | 14.4 | |
| Width (cm) | 12.4 | 9.9 | 9.8 | 11.7 | 11.1 | 13.2 | |
| Thickness (cm) | 0.5 | 0.7 | 0.8 | 0.6 | 0.53 | 0.4 | — |
| Weight (g) | 7.3 | 8.3 | 7.7 | 8.2 | 8.0 | 7.4 | — |
| Residue (%) | 1.7 | 9.5 | 8.2 | 4.5 | 5.4 | 1.2 | —* |
| Static (v) | 2,199 | 1,622 | 9,024 | 3,112 | 2,357 | 1.487 | —* |
| Softness | N/T | N/T | = | N/T | N/T | N/T | —* |
| Fabric-staining | 4.75 | 5.5 | 3.0 | 6.5 | 7.3 | 4.8 | —* |

[a](75% Ditallow Diamido Methosulfate)
[b]90% Dihydrogenated-tallow dimethylammonium methosulfate (Sherex Chem. Co., Dublin, OH)
[c]Kenamide ® B
[d]Incropol ® CS-12
*The sheet prepared according to Example 13 also performed satisfactorily in these tests.

EXAMPLE 14

Fabric-Softening Sheet with Enhanced Strength/Solubility

To study the effect of adding various strength-enhancing additives to the present softener sheet, formulations A-I were prepared according to the formulations shown in Table III below and the procedure of Examples 7–13 above. All of the Examples yielded sheets which were satisfactory in terms of their dimensional stability, and which could be flexed by hand without breaking apart prior to placement in a dryer. The sheets were about 0.026–0.039 inches in average thickness, and weighed about 6.6–9.5 g.

The water solubility of the sheets was also evaluated as follows: A stainless steel plate (16"×16"×⅛") was heated by placing the plate in hot water. The plate was then removed from the water, dried, and allowed to cool until its surface temperature was 82° F, as measured by a surface thermometer. One fabric-softener sheet, prepared as described above, was placed on the 82° F surface of the stainless steel plate, and all four edges of the sheet were securely taped to the plate with duct tape so that a 2½"×2½" square area of the sheet was left exposed. A piece of terry cloth toweling (8"×3¼") was wrapped around a 2½"×2½" cellulose sponge, and the wrapped sponge was wetted with 35° C. water until fully saturated. After squeezing out excess water from the wrapped sponge, 50 ml of water (35° C.) were pipetted onto the wrapped sponge, making sure that the entire surface of the terry cloth towel was evenly wetted. A 720 g standard weight was placed on top of the wetted, wrapped sponge, which was then moved briskly by hand back and forth across the exposed surface of the fabric-softener sheet. The total number of strokes necessary to completely dissolve the sheet were counted and recorded.

Duplicate tests were performed using this procedure for each formulation shown in Table III. The average value of the number of strokes required to dissolve each formulation was recorded as "No. Strokes" in Table III. These values are representative of the relative length of time needed to completely disperse the present sheets when placed in a clothes dryer with damp fabrics.

As indicated by visual observation and the results ("No. Strokes") shown in Table III, the PEG 600 Monostearate, PVP/VA E-335 and E-735, Syntran KL-219-C, and Interpolymer CX30-67-1 were particularly effective in enhancing the strength and water-solubility of the sheets.

TABLE III

| Ingredient | Formulation A | B | C | D | E | F | G | H | I |
|---|---|---|---|---|---|---|---|---|---|
| Solvent | | | | | | | | | |
| Carbitol L.G. | 49.01 | 49.01 | 49.01 | 49.01 | 49.01 | 49.01 | 49.01 | 49.01 | 49.01 |
| Arcosolv TPM | 5.70 | 5.70 | 5.70 | 5.70 | 5.70 | 5.70 | 5.70 | 5.70 | 5.70 |
| Water, Distilled | 19.00 | 19.00 | 19.00 | 19.00 | 19.00 | 19.00 | 19.00 | 19.00 | 19.00 |
| Softener | | | | | | | | | |
| 90% Varisoft 137[a] | 8.33 | 8.33 | 8.33 | 8.33 | 8.33 | 8.33 | 8.33 | 8.33 | 8.33 |
| Sodium Stearate | 12.25 | 12.25 | 12.25 | 12.25 | 12.25 | 12.25 | 12.25 | 12.25 | 12.25 |
| Surfactant | | | | | | | | | |
| Monamid CMA[b] | 4.71 | 4.71 | 4.71 | 4.71 | 4.71 | 4.71 | 4.71 | 4.71 | 4.71 |
| Fragrance | 1.00 | 1.00 | 1.00 | 1.00 | 1.00 | 1.00 | 1.00 | 1.00 | 1.00 |
| Strength/Solubility-Enhancing Additive | | | | | | | | | |
| Pluacol E 1000[c] | 2.00 | — | — | — | — | — | — | — | — |
| PEG-200 Monostearate | — | 2.00 | — | — | — | — | — | — | — |
| PEG-600 Monostearate | — | — | 2.00 | — | — | — | — | — | — |
| PVP-K60[d] | — | — | — | 3.80 | — | — | — | — | — |
| PVP/VA E-335[e] | — | — | — | — | 2.00 | — | — | — | — |
| PVP/VA E-735[f] | — | — | — | — | — | 2.00 | — | — | — |
| Ganex P-904[g] | — | — | — | — | — | — | 2.00 | — | — |
| Syntran KL-219-C[h] | — | — | — | — | — | — | — | 2.00 | — |
| Interpolymer CX30-67-1[i] | — | — | — | — | — | — | — | — | 3.00 |
| Properties of Sheet | 33.0 | 33.0 | 33.7 | 38.7 | 31.7 | 26.0 | 30.0 | 30.3 | 30.3 |
| Average Thickness (Thousands Of Inch) | | | | | | | | | |
| Weight (g) | 8.27 | 8.80 | 8.19 | 9.50 | 8.50 | 6.60 | 7.80 | 7.98 | 7.35 |
| Solubility Test | 23–25 | 27–30 | 19–24 | 24–36 | 16–24 | 15–19 | 25–27 | 15–20 | 13–15 |

TABLE III-continued

| Ingredient | Formulation A | B | C | D | E | F | G | H | I |
|---|---|---|---|---|---|---|---|---|---|
| No. Strokes | | | | | | | | | |

[a]90% Dihydrogenated - tallow dimethylammonium methosulfate (Sherex Chem. Co., Dublin, Ohio)
[b]Cocamide MEA (Mona Industries, Inc., Paterson, New Jersey)
[c]PEG-1000 (BASF Wyandotte Corp., Parsippany, New Jersey)
[d]PVP (GAF Corp., Wayne, New Jersey)
[e]Copolymer of vinyl acetate and vinylpyrrolidone monomers (GAF Corp., Wayne, New Jersey)
[f]Copolymer of vinyl acetate and vinylpyrrolidone monomers (GAF Corp., Wayne, New Jersey)
[g]Butylated PVP (GAF Corp., Wayne, New Jersey)
[h]Water-soluble acrylate copolymer; $(—CH_2CH—COOR)_n$, n > 100 (Interpolymer Corp., Canton, Mass.)
[i]Water-soluble acrylate copolymer; $(CH_2—CH—COOR)_n$, n > 50 (Interpolymer Corp., Canton, Mass.)

EXAMPLE 15

Preferred Fabric-Softening Sheet with Enhanced Strength

Preferred formulations of the present fabric-softening sheet were prepared according to the formulations shown in Table IV below and the procedure of Examples 7–13 above. Both formulations A and B yielded sheets which were satisfactory in terms of their dimensional stability, and which could be flexed by hand without breaking apart prior to placement in a dryer. When evaluated as described in Examples 7–13 above, both sheets deposited no or an insignificant amount of residue in the dryer, and performed at least as well as the Bounce® control sheet in the static, softness and fabric-staining evaluations.

TABLE IV

| Ingredients | Formulation A | B |
|---|---|---|
| Solvent | | |
| Carbitol L.G. | 42.51 | 45.01 |
| Arcosolv TPM | 9.70 | 9.70 |
| Water, distilled | 19.00 | 19.00 |
| Softener | | |

TABLE IV-continued

| Ingredients | Formulation A | B |
|---|---|---|
| Varisoft 137[j] | 8.33 | 6.33 |
| Sodium Stearate | 12.25 | 12.25 |
| Surfactants | | |
| Monamid CMA[k] | 4.71 | 4.71 |
| Jordapon CI[l] | .50 | — |
| Strength-Enhancing Cationic Polymer | | |
| Interpolymer CX30-67-1[m] | 2.00 | 2.00 |
| Fragrance | 1.00 | 1.00 |
| | 100.00 | 100.00 |

[j]90% Dihydrogenated - tallow dimethylammonium methosulfate (Sherex Chem. Co., Dublin, Ohio)
[k]Cocamide MEA (Mona Industries, Inc., Paterson, New Jersey)
[l]Anionic surfactant: sodium cocoyl isethionate (Mazer Chemicals, Gurnee, Ill.)
[m]Water-soluble acrylate copolymer; $(—CH_2—CH—COOR)_n$, n > 50 (Interpolymer Corp., Canton, Mass.)

EXAMPLE 16

Use of Various Quaternary Amine Fabric-Softening Agents

The effectiveness of various quaternary amine fabric softeners was studied by preparing the fabric-softening sheets according to the formulations shown in Table V, below.

TABLE V

| Ingredient | Formulation A | B | C | D | E | F | G | H | I |
|---|---|---|---|---|---|---|---|---|---|
| Solvent | | | | | | | | | |
| Carbitol L.G. | 49.01 | 49.01 | 49.01 | 49.01 | 49.01 | 49.01 | 49.01 | 49.01 | 49.01 |
| Arcosolv TPM | 5.70 | 5.70 | 5.70 | 5.70 | 5.70 | 5.70 | 5.70 | 5.70 | 5.70 |
| Water, Distilled | 19.00 | 17.33 | 19.00 | 17.33 | 17.33 | 19.00 | 19.00 | 17.33 | 17.33 |
| "Quat" Fabric Softener | | | | | | | | | |
| Varisoft ® DHT[n] (90%) | 8.33 | — | — | — | — | — | — | — | — |
| Arquad ® 2HT-75[o] (75%) | — | 10.00 | — | — | — | — | — | — | — |
| Arquad ® 2HT-90MS[p] (90%) | — | — | 8.33 | — | — | — | — | — | — |
| Incrosoft T-75[q] | — | — | — | 10.00 | — | — | — | — | — |
| Incrosoft CFI-75[r] | — | — | — | — | 10.00 | — | — | — | — |
| Incrosoft P-90[s] (6 Mole E.O.) | — | — | — | — | — | 8.33 | — | — | — |
| Incrosoft P-90[t] (10 Mole E.O.) | — | — | — | — | — | — | 8.33 | — | — |
| Alkaquat T[u] (75%) | — | — | — | — | — | — | — | 10.00 | — |
| Carsosoft S-75[v] (75%) | — | — | — | — | — | — | — | — | 10.00 |
| Sodium Stearate | 12.25 | 12.25 | 12.25 | 12.25 | 12.25 | 12.25 | 12.25 | 12.25 | 12.25 |
| Surfactant | | | | | | | | | |
| Monamid CMA | 4.71 | 4.71 | 4.71 | 4.71 | 4.71 | 4.71 | 4.71 | 4.71 | 4.71 |
| Fragrance | 1.00 | 1.00 | 1.00 | 1.00 | 1.00 | 1.00 | 1.00 | 1.00 | 1.00 |
| | 100.00 | 100.00 | 100.00 | 100.00 | 100.00 | 100.00 | 100.00 | 100.00 | 100.00 |
| Properties of Sheet Weight (g) | 8.48 | 8.30 | 7.76 | 8.00 | 8.37 | 8.53 | 7.16 | 6.74 | 7.43 |
| Solubility Test[w] | 21 | 29 | 19 | 26 | 29 | 28 | 23 | 20 | 24 |

TABLE V-continued

| Ingredient | Formulation A | B | C | D | E | F | G | H | I |
|---|---|---|---|---|---|---|---|---|---|
| No. Of Strokes | | | | | | | | | |

[a]Dimethyldihydrogenatedtallow ammonium chloride (Sherex Chemical Co., Dublin, Ohio)
[b]Ditallow(dimethyl)ammonium chloride (Akzo Chemie, McCook, Illinois)
[c]Dimethyldihydrogenatedtallow ammonium methyl sulfate (Akzo Chemie, McCook, Illinois)
[d]Ditallowdiamidomethosulfate (quaternium 53) (Croda, Inc., New York, N.Y.)
[e]Alkylimidazolinium methosulfate (Croda, Inc., New York, N.Y.)
[f]Ditallowdiamidomethosulfate (6 mole E.O.) (Croda, Inc., New York, N.Y.)
[g]Ditallowdiamidomethosulfate (10 mole E.O.) (Croda, Inc., New York, N.Y.)
[h]Ditallowimidazolinium quaternary (Alkaril Chemicals, Ltd., Mississauga, Ontario, Canada)
[i]Quaternium-27 (Lonza, Inc., Fairlawn, New Jersey)
[w]Performed according to the procedures of Example 14.

EXAMPLE 17

Base Sheet

A base sheet which did not incorporate a fabric-modifying agent was made according to the formulation shown in Table VI, below.

Specifically, Carbitol ® L. G. solvent ((2-(2-ethoxyethoxy)ethanol), 46.3 g) was added to a beaker equipped with mechanical stirring, followed by Arcosolv TPM solvent (9.7 g), followed by 20.3 g of distilled water. The stirred reaction mixture was heated to 60° C, at which point 13.5 g of sodium stearate were added. Heating was continued until the stirred mixture reached a temperature of 80° C, at which it was maintained thereafter. Next, 6.0 g of Monamid ® CMA (cocamide MEA, Mona Industries, Inc., Paterson, New Jersey) surfactant were added. Stirring was continued until the mixture was homogeneous. A water-soluble cationic acrylic resin (CX30-67-1, Interpolymer Corp., Canton, Mass., 3.3 g) was slowly added, followed by 1.0 g of fragrance (Belmay). After 1-2 minutes of additional stirring, stirring was discontinued.

The mixture was cast into thin sheets by dipping a highly polished chrome plate into the 80° C mixture for 5 seconds. The liquid-coated plate was removed and cooled and the gelled sheet was stripped from the plate. Flexible, translucent (almost clear) sheets resulted.

TABLE VI

| Ingredients | Base Sheet % |
|---|---|
| Solvent | |
| Carbitol ® L.G. | 46.27 |
| Arcosolv TPM | 9.70 |
| Water, distilled | 20.26 |
| Surfactant | |
| Sodium stearate | 13.51 |
| Monamid CMA[x] | 5.97 |
| Strength-Enhancing Cationic Polymer | |
| Interpolymer CX30-67-1[y] | 3.29 |
| Fragrance | 1.00 |
| | 100.00 |

[x]Cocamide MEA (Mona Industries, Inc., Paterson, New Jersey)
[y]Water-soluble acrylate copolymer; $(CH_2—CH—COOR)_n$, n > 50 (Interpolymer Corp., Canton, Mass.)

EXAMPLE 18

Fabric-Modifier Sheet

A fabric-modifier sheet may be made according to the present invention by following the procedure of Example 17 above, with the following exception: the total amount of solvent (e.g., Carbitol ® L.G., Arcosolv TPM, and distilled water) will be reduced by approximately 10 g, to be replaced by a like amount of one or more fabric-modifying agents. For example, a mixture of fabric-modifying agents including about 30% anti-creasing agent, about 60% antistatic agent, about 9% brightening agent and about 1% fragrance, by weight, may be used. The fabric-modifying agents may be added to the stirred mixture following addition of the sodium stearate and prior to addition of the surfactant.

The resulting fabric-modifying sheet can be used in the same manner as the present fabric-softening sheet; e.g., the fabric-modifying sheet may be placed in a clothes dryer drum and tumbled with damp wash while the wash dries, for about 55 minutes. After about 20 minutes, the fabric-modifier sheet is completely consumed, and the fabric-modifying agent has been effectively applied to the test fabrics.

The invention has been described with reference to various specific and preferred embodiments and techniques. However, it should be understood that many variations and modifications may be made while remaining within the spirit and scope of the invention.

What is claimed is:

1. A fabric-modifier comprising dimensionally stable gelled sheet consisting essentially of about 15–30% water, about 40–60% of a water-miscible organic solvent selected from the group consisting of a polyethylene glycol, a lower alkanol, a glycol ether, a pyrrolidinone and mixtures thereof, and an amount of a fatty acid salt effective to form a dimensionally gelled stable sheet, having uniformly distributed therein an effective amount of a fabric-modifying agent selected from the group consisting of a quaternary ammonium salt, an imidazolinium salt, a stearyl amine salt, a nonionic surfactant, an amphoteric surfactant and mixtures thereof; wherein said sheet leaves an insignificant residue in a rotary hot air dryer following a laundry drying cycle.

2. The fabric modifier of claim 1 wherein the organic solvent comprises a glycol ether.

3. The fabric modifier of claim 2 wherein the glycol ether comprises 2-ethanol.

4. A fabric modifier comprising a gelled sheet formed by a process comprising:

(a) forming a uniform liquid dispersion consisting essentially of an effective amount of a fabric-modifying agent selected from the group consisting of a quaternary ammonium salt, an imidazolinium salt, a stearyl amine salt, a nonionic surfactant, an amphoteric surfactant and mixtures thereof, and about 7–20% of a fatty acid salt in about 15–30% water and about 40–60% of a water-miscible organic solvent selected from the group consisting of a polyethylene glycol, a lower alkanol, a glycol ether, a pyrrolidinone and mixtures thereof; and (b) forming the dispersion into a dimensionally stable gelled sheet; wherein said sheet leaves an insignificant residue in a rotary hot air dryer following a laundry drying cycle.

5. The fabric modifier of claim 4 wherein the dispersion further comprises an effective amount of fragrance.

6. The fabric modifier of claim 4 wherein the gelling agent is an alkali metal fatty acid salt which is formed in the dispersion by neutralizing a fatty acid with an alkali metal hydroxide.

7. A method for depositing a fabric-modifying agent on fabrics in a rotary hot air dryer comprising placing the fabric modifier of claim 1 or claim 34 in which the dryer with the wet fabrics, and operating the dryer to dry the fabrics.

* * * * *